US009470446B2

(12) United States Patent
Yao et al.

(10) Patent No.: US 9,470,446 B2
(45) Date of Patent: Oct. 18, 2016

(54) REFRIGERATOR AND ICE MAKER COMPRISING THE SAME ICE TRAY HAVING A WATER SPILLAGE TROUGH

(75) Inventors: Jun Yao, Hefei (CN); Lingyun Li, Hefei (CN); Dongxian Liu, Hefei (CN)

(73) Assignees: Hefei Midea Refrigerator Co., Ltd., Hefei (CN); Hefei Hualing Co., Ltd., Hefei (CN)

( * ) Notice: Subject to any disclaimer, the term of this patent is extended or adjusted under 35 U.S.C. 154(b) by 243 days.

(21) Appl. No.: 14/007,937

(22) PCT Filed: May 20, 2011

(86) PCT No.: PCT/CN2011/074425

§ 371 (c)(1),
(2), (4) Date: Sep. 26, 2013

(87) PCT Pub. No.: WO2012/149694

PCT Pub. Date: Nov. 8, 2012

(65) Prior Publication Data

US 2014/0020422 A1 Jan. 23, 2014

(30) Foreign Application Priority Data

May 5, 2011 (CN) ..... 2011 1 0115658

(51) Int. Cl.

| | |
|---|---|
| ***F25C 5/18*** | (2006.01) |
| ***F25C 1/04*** | (2006.01) |
| ***F25C 5/00*** | (2006.01) |
| *F25C 1/22* | (2006.01) |

(52) U.S. Cl.

CPC . *F25C 1/04* (2013.01); *F25C 1/22* (2013.01); *F25C 5/005* (2013.01); *F25C 1/225* (2013.01); *F25C 2400/14* (2013.01); *F25C 2500/00* (2013.01); *F25C 2500/06* (2013.01); *F25C 2500/08* (2013.01); *F25C 2700/04* (2013.01)

(58) Field of Classification Search

CPC ..... F25C 2500/06; F25C 2500/00; F25C 2700/04; F25C 2400/14; F25C 1/04; F25C 1/22; F25C 1/225; F25C 2500/08

See application file for complete search history.

(56) References Cited

U.S. PATENT DOCUMENTS

| | | | | |
|---|---|---|---|---|
| 2006/0207282 | A1* | 9/2006 | Visin et al. | 62/351 |
| 2008/0295537 | A1* | 12/2008 | An et al. | 62/344 |
| 2010/0122543 | A1 | 5/2010 | Lee et al. | |

FOREIGN PATENT DOCUMENTS

| | | |
|---|---|---|
| CN | 101315240 | 12/2008 |
| CN | 101490487 | 7/2009 |
| JP | 2008304101 | 12/2008 |
| KR | 20090132401 | 12/2009 |

OTHER PUBLICATIONS

PCT/CN2011/074425 Translation of the International Search Report mailed Mar. 1, 2012, 5 pages.

* cited by examiner

*Primary Examiner* — Marc Norman
*Assistant Examiner* — David Teitelbaum
(74) *Attorney, Agent, or Firm* — Lathrop & Gage LLP

(57) ABSTRACT

An ice making tray for an ice maker, an ice maker and a refrigerator comprising the same are provided. The ice maker is disposed on a door of a refrigerator. The ice making tray includes: a tray body provided with a plurality of ice forming chambers being downwardly concave, in which an opening for water flowing is formed between adjacent ice forming chambers; a water storage trough disposed on a front side of the tray body, and being higher than the plurality of ice forming chambers, in which the water storage trough is communicated with the plurality of ice forming chambers via at least one water returning mouth; and an enclosure wall, disposed around an upper end of the tray body.

16 Claims, 3 Drawing Sheets

REFRIGERATOR AND ICE MAKER COMPRISING THE SAME ICE TRAY HAVING A WATER SPILLAGE TROUGH

CROSS-REFERENCE TO RELATED APPLICATION

This application claims priority to and benefits of Chinese Patent Application Serial No. 201110115658.3, filed with the State Intellectual Property Office of P. R. China on May 5, 2011, the entire contents of which are incorporated herein by reference.

FIELD

The present disclosure relates to a refrigeration equipment field, and more particularly relates to an ice making tray for an ice maker, an ice maker and a refrigerator comprising the ice maker.

BACKGROUND

An ice maker disposed on a door of a refrigerator represents a mainstream and a direction of the development of the refrigerator. However, as the door of the refrigerator is a removable element, when a user opens or closes the door of the refrigerator with a great force, water inside the ice maker disposed on the door of the refrigerator would overflow forward and spill into the refrigerator due to an inertia. Then, as the ice maker is usually at a very low temperature, the water spilled into the refrigerator will be frozen quickly, which may influence the function and performance of other elements in the refrigerator.

SUMMARY

The present disclosure aims to solve at least one of the problems in the prior art.

For this, one objective of the present disclosure is to provide an ice making tray for an ice maker which solves a problem of water overflowing during a shaking thereof.

Another objective of the present disclosure is to provide an ice maker comprising the above ice making tray.

Yet another objective of the present disclosure is to provide a refrigerator comprising the above ice maker.

According to embodiments of a first aspect of the present disclosure, an ice making tray for an ice maker is provided. The ice maker is disposed on a door of a refrigerator. The ice making tray comprises: a tray body provided with a plurality of ice forming chambers being downwardly concave, in which an opening for water flowing is formed between adjacent ice forming chambers; a water storage trough disposed on a front side of the tray body, and being higher than the plurality of ice forming chambers, in which the water storage trough is communicated with the plurality of ice forming chambers via at least one water returning mouth; and an enclosure wall, disposed around an upper end of the tray body.

With the ice making tray according to embodiments of the present disclosure, by providing a water storage trough and at least one water returning mouth on the front side of the tray body, when the user opens or closes the door of the refrigerator, the water in the tray body spills forward into the water storage trough instead of the refrigerator, and when the door of the refrigerator becomes stable, the water in the water storage trough quickly returns to the tray body via the water returning mouth. Thus, the ice maker and the other elements in the refrigerator are ensured to operate normally.

In addition, the ice making tray for the ice maker according to embodiments of the present disclosure may also have the following additional technical features.

In one embodiment of the present disclosure, the front side of the tray body is extended forward to form a front edge, a convex edge protruding upwards is formed on an upper surface of the front edge, and the convex edge is extended in a longitudinal direction and is lower than the enclosure wall, in which the water storage trough is defined by the convex edge and a front portion of the enclosure wall. Thus, when the ice making tray shakes and the water therein spills forward into the water storage trough, as the height of the convex edge is lower than that of the front portion of the enclosure wall, the water would not spill onto the other elements in the refrigerator.

Alternatively, the at least one water returning mouth is configured to be a gap formed in the convex edge.

In one embodiment of the present disclosure, one water returning mouth is formed.

In some embodiments of the present disclosure, the one water returning mouth is formed at a left end or a right end of the convex edge.

Alternatively, the one water returning mouth is formed in a center of the convex edge.

In another embodiment of the present disclosure, two water returning mouths are formed.

Alternatively, a bottom surface of at least one the water returning mouth is level with the upper surface of the front edge.

According to embodiments of a second aspect of the present disclosure, an ice maker is provided. The ice maker comprises an ice making tray for an ice maker according to embodiments of the first aspect of the present disclosure.

According to embodiments of a third aspect of the present disclosure, a refrigerator is provided. The refrigerator comprises: a main body with an open front side; a door rotatably disposed on the front side of the main body for opening or closing the main body; and an ice maker according to embodiments of the second aspect of the present disclosure disposed on the door.

Additional aspects and advantages of the present disclosure will be given in part in the following descriptions, become apparent in part from the following descriptions, or be learned from the practice of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
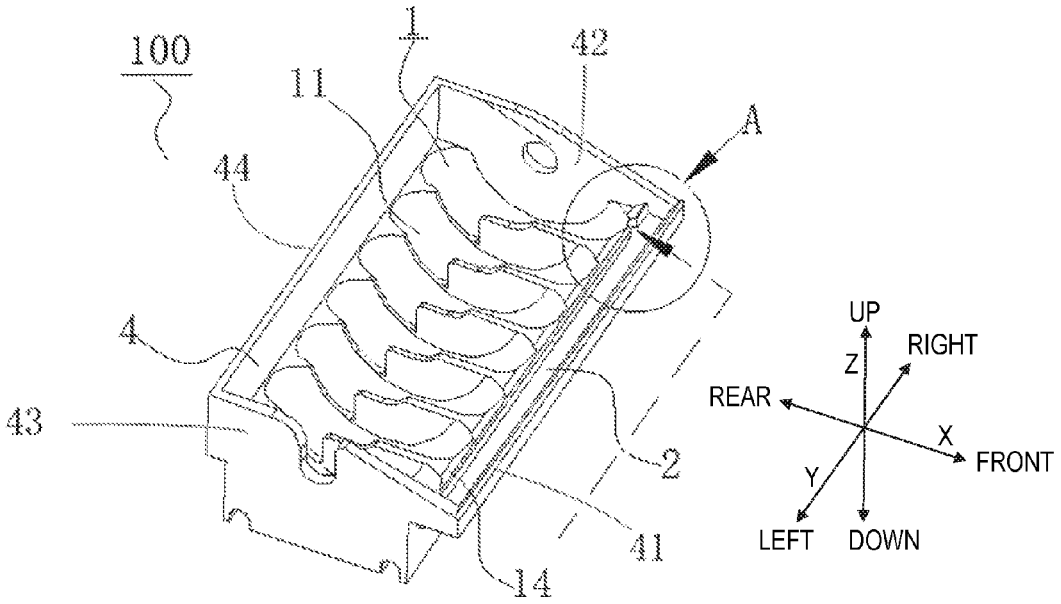
FIG. 1 is a perspective view of an ice making tray for an ice maker according to an embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

It is to be understood that phraseology and terminology used herein with reference to device or element orientation (such as, terms like "center", "up", "down", "front", "rear", "left", "right", "top", "bottom", "inside", "outside") are only used to simplify description of the present invention, and do not indicate or imply that the device or element referred to must have or operated in a particular orientation. They cannot be seen as limits to the present disclosure. Moreover, terms of "first" and "second" are only used for description and cannot be seen as indicating or implying relative importance.

It is to be explained that terms of "installation", "linkage" and "connection" shall be understood broadly, for example, it could be permanent connection, removable connection or integral connection; it could be direct linkage, indirect linkage or inside linkage within two elements. Those skilled in the art shall understand the concrete notations of the terms mentioned above according to specific circumstances.

In the following, an ice making tray 100 for an ice maker according to a first aspect of the present disclosure will be described with reference to FIGS. 1-7. The ice maker is disposed on a door of a refrigerator. As illustrated in FIG. 1, a defined frame of reference having three orthogonally oriented axes, including an X-axis having a front direction and a rear direction along a width of the tray, a Y-axis having a left direction and a right direction along a length of the tray, and a Z-axis having an up direction and a down direction along a height of the tray.

The ice making tray 100 according to an embodiment of the present disclosure comprises a tray body 1, a water storage trough 2 and an enclosure wall 4. As shown in FIGS. 1-5, a plurality of ice forming chambers 11 being downwardly concave are formed in the tray body 1 and an opening 12 for water flowing is provided between two adjacent ice forming chambers 11. The opening 12 makes water flow among the plurality of ice forming chambers 11 and thus makes upper surfaces of the ice formed in the plurality of ice forming chambers 11 level with each other.

The water storage trough 2 is disposed on a front side of the tray body 1 along the X-axis and is higher along the Z-axis than the plurality of ice forming chambers 11. The water storage trough 2 is communicated with the plurality of ice forming chambers 11 via at least one water returning mouth 3. Thus, when water is stored in the water storage trough 2, the water falls down into the ice forming chamber 11 corresponding to the water returning mouth 3 due to a height difference between the water storage trough 2 and the ice forming chamber 11, and then the water is uniformly distributed to individual ice forming chambers 11 via the openings 12. The enclosure wall 4 is disposed around a top end of the tray body 1 to prevent the water from spilling out of the ice making tray 100 when the ice making tray 100 shakes under an external force. Specifically, the enclosure wall 4 comprises a front portion 41 along the X-axis, a left portion 42 orthogonal to the front portion along the Y-axis, a right portion 43 opposite the left portion, and a rear portion 44 opposite the front portion.

With the ice making tray 100 according to embodiments of the present disclosure, by providing the water storage trough 2 and the at least one water returning mouth 3 on the front side of the tray body 1, when the user opens or closes the door of the refrigerator, water in the tray body 1 spills forward into the water storage trough 2 instead of the refrigerator, and when the door of the refrigerator becomes stable, water in the water storage trough 2 quickly returns to the tray body 1 via the water returning mouths 3. Thus, the ice maker and the other elements in the refrigerator are ensured to operate normally.

Figure 4:
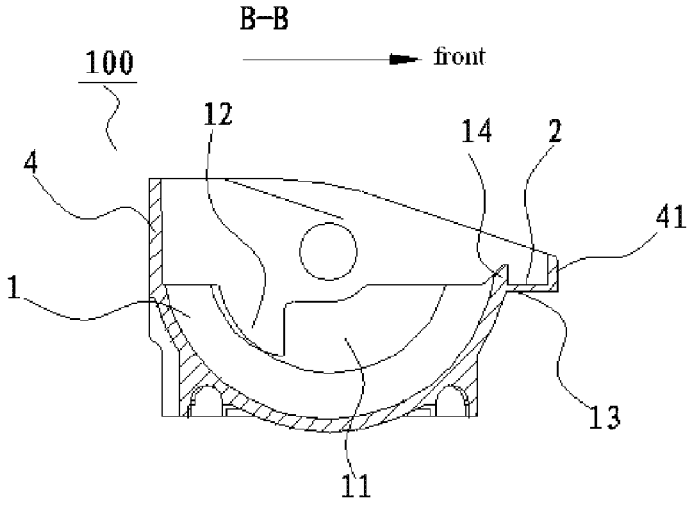
FIG. 4 is a sectional view of the ice making tray shown in FIG. 1 in a B-B direction shown in FIG. 3.
Figure 5:
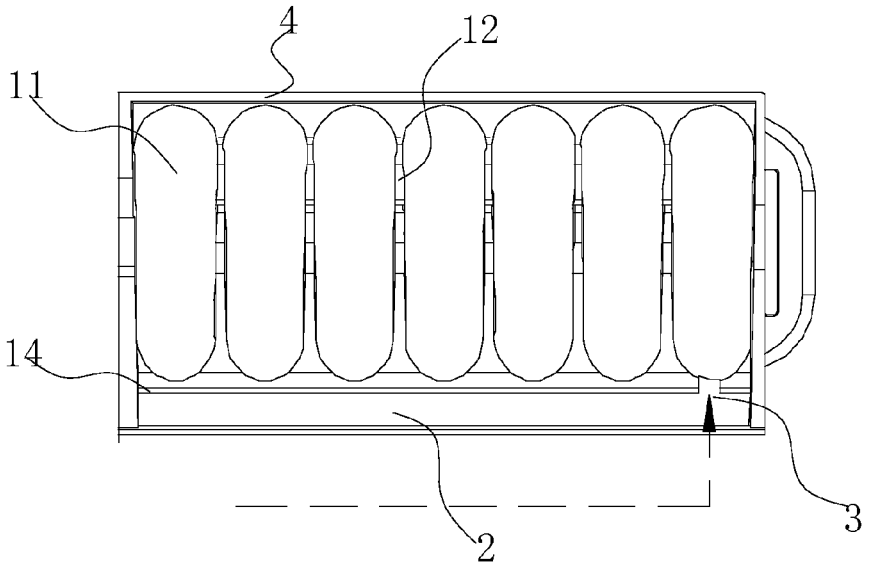
FIG. 5 is a top view of the ice making tray shown in FIG. 1.

As shown in FIG. 4, in one embodiment of the present disclosure, the front side of the tray body 1 is extended forward to form a front edge 13, a convex edge 14 protruding upwards is formed on an upper surface of the front edge 13, and the convex edge 14 is extended lengthwise along the Y-axis (as shown in FIG. 1) and is lower than the enclosure wall 4 along the Z-axis, i.e., the convex edge 14 is lower than any one of the front portion 41, the left portion 42, the right portion 43 and the rear portion 44 of the enclosure wall 4. The water storage trough 2 is defined by the convex edge 14 and the front portion 41 of the enclosure wall 4. Therefore, when the ice making tray 100 shakes, water spills forward into the water storage trough 2 and does not spill onto the other elements in the refrigerator, as the convex edge 14 is lower than the front portion 41.

Figure 6:
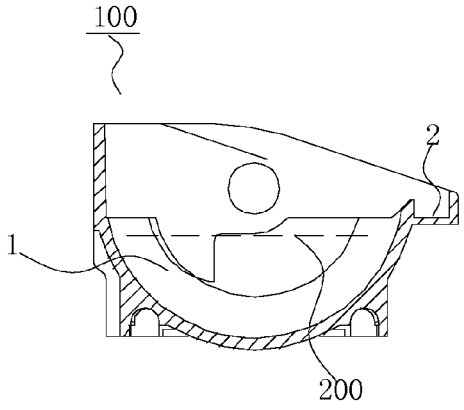
FIG. 6 shows a water surface when the ice making tray shown in FIG. 1 is in a stable state.
Figure 7:
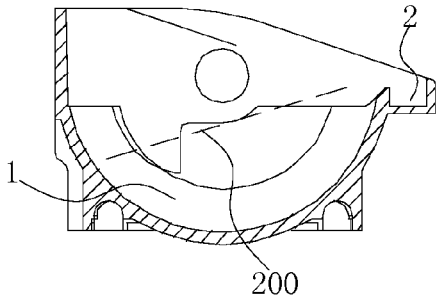
FIG. 7 shows a water surface when the ice making tray shown in FIG. 1 shakes.

FIG. 6 shows a water surface 200 in the tray body 1 when the door of the refrigerator is in a stable state and FIG. 7 shows a water surface 200 when water spills into the water storage trough 2 during the shaking of the ice making tray 100.

Figure 2:
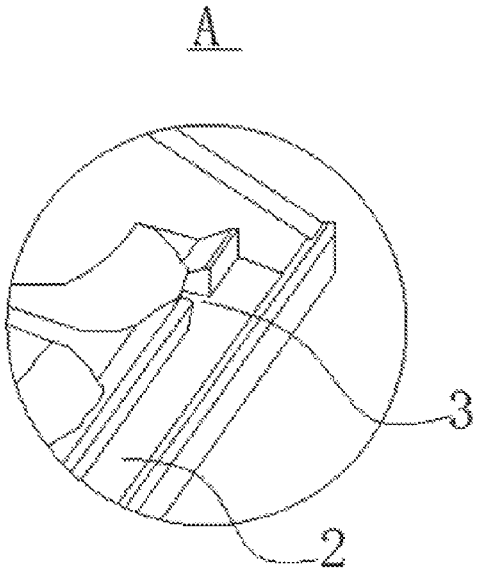
FIG. 2 is an enlarged view of a part A shown in FIG. 1.
Figure 3:
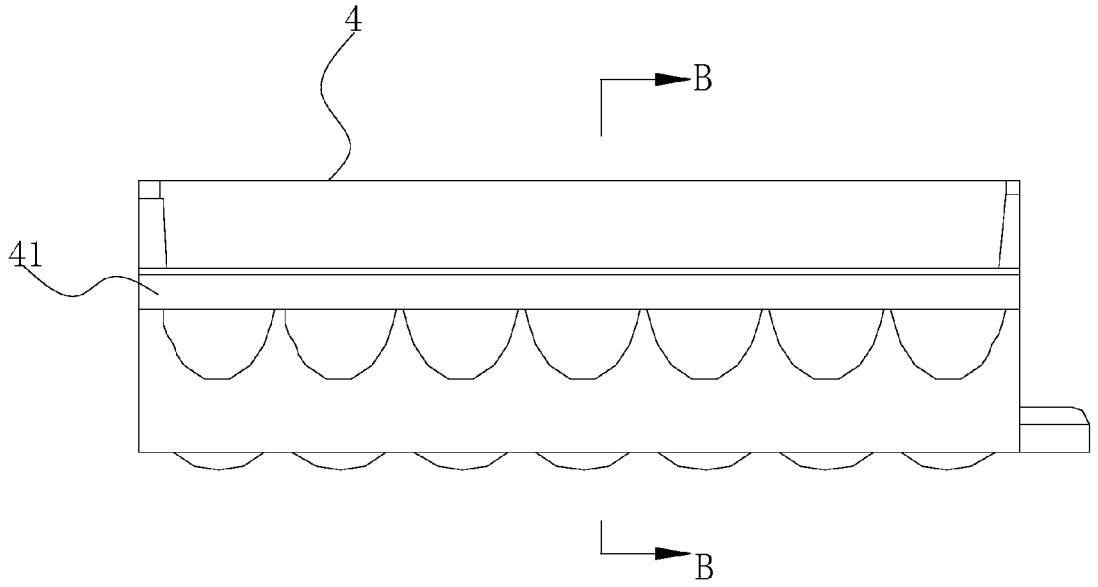
FIG. 3 is a front view of the ice making tray shown in FIG. 1.

As shown in FIG. 2, the at least one water returning mouth 3 is configured to be a gap in the convex edge 14. In one embodiment, only one water returning mouth 3 is formed. In some embodiments of the present disclosure, the water returning mouth 3 is formed at a left end or a right end of the convex edge 14. In other embodiments, the water returning mouth 3 may be formed in a center of the convex edge 14. Those skilled in the art should understand that the water returning mouth 3 may be formed in any position of the convex edge 14.

Alternatively, two water returning mouths 3 may be formed. Certainly, the present disclosure is not limited to this. Three or more water returning mouths 3 may be formed, as long as the water in the water storage trough 2 can return to the tray body 1 via the water returning mouths 3.

A bottom surface of the at least one water returning mouth 3 may be level with the upper surface of the front edge 13, i.e. the at least one water returning mouth 3 is formed so that the upper surface of the front edge 13 is exposed. Certainly, the bottom surface of the water returning mouth 3 may also be slightly higher or lower than the upper surface of the front edge 13, as long as the water in the water storage trough 2 can return to the tray body 1 quickly.

An ice maker is also provided according to a second aspect of the present disclosure. The ice maker comprises an ice making tray 100 for an ice maker described above. Other components such as an ice making motor and a control system in the ice maker according to embodiments of the present disclosure and the operation thereof are known to those skilled in the art and are not described in detail herein.

A refrigerator is also provided according to a third aspect of the present disclosure. The refrigerator comprises: a main body, a door and an ice maker described above. The front side of the main body is open. The door is rotatably disposed on the front side of the main body for opening or closing the main body. The ice maker is disposed on the door. Other components such as a refrigerating element and a freezing element in the refrigerator according to embodiments of the present disclosure and the operation thereof are known to those skilled in the art and are not described in detail herein.

Reference throughout this specification to "an embodiment", "some embodiments", "one schematic embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. An ice making tray for an ice maker, wherein the ice maker is disposed on a door of a refrigerator, and the ice making tray comprises:

a tray body provided with a plurality of ice forming chambers being concave in a downward direction parallel to a Z-axis, wherein the Z-axis extends in a direction parallel with gravity, in which an opening for water flowing is formed between adjacent ice forming chambers;

a water storage trough disposed on a front side of the tray body in a frontward direction parallel to an X-axis, wherein the X-axis perpendicular to the Z-axis and extends parallel with a longest distance of the ice forming chambers, and being higher than the plurality of ice forming chambers in an upward direction parallel to the Z-axis, in which the water storage trough is communicated with the plurality of ice forming chambers via at least one water returning mouth; and an enclosure wall, disposed around a top end of the tray body and the water storage trough, and extending above the tray body and the water storage trough in the upward direction, including a front portion, a left portion orthogonal to the front portion, a right portion opposite the left portion, and a rear portion opposite the front portion, wherein the front side of the tray body is extended in the frontward direction to form a front wall, wherein the front wall is a bottom of the water storage trough, a convex surface protruding in the upward direction is formed on an upper surface of the front wall, and the convex surface extends in a lengthwise direction parallel to a Y-axis, wherein the Y-axis is perpendicular to the Z-axis and the X-axis, and is lower than any one of the front portion, the left portion, the right portion and the rear portion of the enclosure wall in the downward direction, such that the water storage trough is defined by the convex surface of the tray body, the front wall, the left portion of the enclosure wall, the right portion of the enclosure wall, and the front portion of the enclosure wall.

2. The ice making tray according to claim 1, wherein the at least one water returning mouth is configured to be a gap formed in the convex surface.

3. The ice making tray according to claim 2, wherein the at least one water returning mouth comprises two water returning mouths.

4. The ice making tray according to claim 2, wherein a bottom surface of at least one of the at least one water returning mouths is level with the upper surface of the front wall.

5. The ice making tray according to claim 1, wherein the at least one water returning mouth is formed at a left end or a right end of the convex surface.

6. The ice making tray according to claim 1, wherein the at least one water returning mouth is formed in a center of the convex surface.

7. An ice maker, comprising an ice making tray, wherein the ice maker is disposed on a door of a refrigerator, and the ice making tray comprises:

a tray body provided with a plurality of ice forming chambers being concave in a downward direction parallel to a Z-axis, wherein the Z-axis extends in a direction parallel with gravity, in which an opening for water flowing is formed between adjacent ice forming chambers;

a water storage trough disposed on a front side of the tray body in a frontward direction parallel to an X-axis, wherein the X-axis perpendicular to the Z-axis and extends parallel with a longest distance of the ice forming chambers, and being higher than the plurality of ice forming chambers in an upward direction parallel to the Z-axis, in which the water storage trough is communicated with the plurality of ice forming chambers via at least one water returning mouth; and an enclosure wall, disposed around a top end of the tray body and the water storage trough, and extending above the tray body and the water storage trough in the upward direction, including a front portion, a left portion orthogonal to the front portion, a right portion opposite the left portion, and a rear portion opposite the front portion, wherein the front side of the tray body is extended in the frontward direction to form a front wall, wherein the front wall is a bottom of the water storage trough, a convex surface protruding in the upward direction is formed on an upper surface of the front wall, and the convex surface extends in a lengthwise direction parallel to a Y-axis, wherein the Y-axis is perpendicular to the Z-axis and the X-axis, and is lower than any one of the front portion, the left portion, the right portion and the rear portion of the enclosure wall in the downward direction, such that the water storage trough is defined by the convex surface of the tray body, the front wall, the left portion of the enclosure wall, the right portion of the enclosure wall, and the front portion of the enclosure wall.

8. The ice maker according to claim 7, wherein the at least one water returning mouth is configured to be a gap formed in the convex surface.

9. The ice maker according to claim 8, wherein one water returning mouth is formed; and the one water returning mouth is formed at a left end or a right end of the convex surface, or formed in a center of the convex surface.

10. The ice maker according to claim 8, wherein the at least one water returning mouth comprises two water returning mouths.

11. The ice maker according to claim 8, wherein a bottom surface of at least one of the water returning mouths is level with the upper surface of the front wall.

12. A refrigerator, comprising:

a main body with an open front side;

a door, rotatably disposed on the front side of the main body for opening or closing the main body; and an ice maker disposed on the door, wherein the ice maker comprises an ice making tray, and the ice making tray comprises:

a tray body provided with a plurality of ice forming chambers being downwardly concave in a downward direction parallel to a Z-axis, wherein the Z-axis extends in a direction parallel with gravity, in which an opening for water flowing is formed between adjacent ice forming chambers;

a water storage trough disposed on a front side of the tray body in a frontward direction parallel to an X-axis, wherein the X-axis perpendicular to the Z-axis and extends parallel with a longest distance of the ice forming chambers, and being higher than the plurality of ice forming chambers in an upward direction parallel to the Z-axis, in which the water storage trough is communicated with the plurality of ice forming chambers via at least one water returning mouth; and an enclosure wall, disposed around a top end of the tray body and the water storage trough, and extending above the tray body and the water storage trough in the upward direction, including a front portion, a left portion orthogonal to the front portion, a right portion opposite the left portion, and a rear portion opposite the front portion, wherein the front side of the tray body is extended in the frontward direction to form a front wall, wherein the front wall is a bottom of the water storage trough, a convex surface protruding upwards in the upward direction is formed on an upper surface of the front wall, and the convex surface extends in a lengthwise direction parallel to a Y-axis, wherein the Y-axis is perpendicular to the Z-axis and the X-axis, and is lower than any one of the front portion, the left portion, the right portion and the rear portion of the enclosure wall in the downward direction, such that the water storage trough is defined by the convex surface of the tray body, the front wall, the left portion of the enclosure wall, the right portion of the enclosure wall, and the front portion of the enclosure wall.

13. The refrigerator according to claim 12, wherein the at least one water returning mouth is configured to be a gap formed in the convex surface.

14. The refrigerator according to claim 13, wherein one water returning mouth is formed; and the one water returning mouth is formed at a left end or a right end of the convex surface, or formed in a center of the convex surface.

15. The refrigerator according to claim 13, wherein the at least one water returning mouth comprises two water returning mouths.

16. The refrigerator according to claim 13, wherein a bottom surface of at least one of the water returning mouths is level with the upper surface of the front wall.

* * * * *